United States Patent [19]

Ueno et al.

[11] Patent Number: 4,836,267

[45] Date of Patent: Jun. 6, 1989

[54] VERTICAL DIE CASTING METHOD AND APPARATUS

[75] Inventors: Toyoaki Ueno; Sadayuki Dannoura, both of Ube, Japan

[73] Assignee: Ube Industries, Ltd., Japan

[21] Appl. No.: 210,903

[22] Filed: Jun. 24, 1988

[30] Foreign Application Priority Data

May 8, 1987 [JP] Japan ..... 62-110656

[51] Int. Cl.[4] ..... B22D 17/12; B22D 17/26

[52] U.S. Cl. ..... 164/113; 164/137; 164/312; 164/314; 164/340; 164/341; 164/342; 164/343

[58] Field of Search ..... 164/113, 137, 312, 314, 164/340, 341, 342, 343

[56] References Cited

U.S. PATENT DOCUMENTS

| | | | |
|---|---|---|---|
| 4,088,178 | 5/1978 | Ueno et al. | 164/312 X |
| 4,286,648 | 9/1981 | Takeshima et al. | 164/312 |
| 4,287,935 | 9/1981 | Ueno et al. | 164/312 X |
| 4,417,616 | 11/1983 | Seitz | 164/113 |
| 4,655,274 | 4/1987 | Dannoura | 164/342 X |

FOREIGN PATENT DOCUMENTS

| | | | |
|---|---|---|---|
| 52-16424 | 2/1977 | Japan | 164/113 |
| 57-109564 | 7/1982 | Japan | 164/342 |
| 58-145347 | 8/1983 | Japan | 164/342 |
| 59-52631 | 3/1984 | Japan | 164/137 |
| 755421 | 8/1980 | U.S.S.R. | 164/342 |

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A vertical die casting apparatus comprises a mold clamping unit having a mold axis and a tilting injection unit. The mold clamping unit in cooperation with a machine base is made to swing about a rotation axis from a normal horizontal axis position at which the mold axis extends horizontally and the injection unit is actuated for a vertical injection, to a vertical axis position at which the mold axis extends vertically, and a disintegratable core incorporated in the mold to define a mold cavity.

11 Claims, 6 Drawing Sheets

(V)

(V)

VERTICAL DIE CASTING METHOD AND APPARATUS

BACKGROUND OF THE INVENTION

1. Field of the Invention

The present invention relates to an improved casting method and apparatus for producing a cast product of aluminum or the like, particularly preferable when a disintegratable core or a sand core is set into a mold at every casting shot.

2. Description of the Related Art

A cast product having an undercut portion or a cavity is generally prepared by a gravity casting machine, which is a casting machine having a relatively low pressure, or a low-pressure molding machine, while utilizing a sand core formed by solidifying a casting sand by a phenolic resin or the like. The low-pressure casting machine, however, is defective in that the casting cycle is long, the thickness of a cast product cannot be reduced, and it is difficult to stabilize the quality of the cast product. Recently, however, it has become possible to perform the casting, operation by a high-pressure casting machine by utilizing a disintegratable core such as a sand core, by which the melt is prevented from intruding into the core and the die casting method is improved.

The high-pressure casting machine is classified as a lateral casting system or a vertical casting system, according to the casting direction. The lateral casting system was a lateral die casting machine, and the casting machine used by the vertical casting system is classified as a vertical clamping type or a lateral clamping type.

The high-pressure casting machine of the vertical casting system gives especially excellent results in that, since the contact area between the metal and the melt cast in a casting sleeve is small, there is little reduction of the temperature of the melt and the intrusion of a gas into the casting sleeve is inhibited.

In the casting method and casting machine using a disintegratable core, the disintegratable core must be easily attached to the molds, the melt must run correctly during the casting operation, and defects such as blow holes formed by an intrusion of gas into a cast product and cavities such as ingot piping caused by solidification and contraction, must not be formed. The disintegratable core must not be broken during the casting operation, there must be no intrusion of the molten metal into the sand core, i.e., melt intrusion, the core must be easily removed after the casting operation, and no sand must remain on the cast product.

As pointed out hereinbefore, the high-pressure casting machine is classified as the lateral clamping type or the vertical clamping type, according to the clamping direction, and as the lateral casting system or the vertical casting system according to the casting direction.

In the lateral clamping type, since the melt is filled in the rising state in the cavity, there is less intrusion of gas than in the vertical clamping type during the casting operation, and since a gas vent formed on the parting face of the mold is not clogged before completion of the filling operation, casting defects such as blow holes do not occur.

In the vertical casting system, since the contact area between the metal and the melt cast in the casting sleeve is smaller than in the lateral casting system, there is less reduction of the temperature of the melt, and since the intrusion of gas does not occur in the injection sleeve during the casting operation, casting defects such as blow holes do not occur.

Accordingly, for the above-mentioned reasons, a high-pressure casting machine of the vertical casting system and lateral clamping type is most widely used as the high-pressure casting machine using a disintegratable core. Although a product having a high casting quality can be produced by this casting machine, the attachment of the disintegratable core to the molds is cumbersome, and particularly when the disintegratable core is supported by a movable core, since the disintegratable core must be suspended in the air, and thus is not precisely positioned, the disintegratable core can be easily broken by collision with the mold. Furthermore, when the skirt portion of the disintegratable core is inserted into the supporting portion of the mold, the sand constituting the skirt portion is eroded by rubbing on the mold and intrudes into the melt during the casting operation to form defects, and thus it is difficult to easily obtain a good product. Moreover, in principle, automation of the attachment of the disintegratable core is impossible.

SUMMARY OF THE INVENTION

A primary object of the present invention is to overcome the above-mentioned disadvantages and greatly improve the quality of a cast product prepared by using a disintegratable core and to provide a casting machine in which automatic attachment of the disintegratable core is possible. According to the present invention, there is provided a die casting machine comprising: a mold clamping unit (20) having a mold axis plane, incorporated with a platen (21) and mold half (27) detachably mounted thereto and stationary relative to the mold axis, and a counterpart platen (22) and mold half (28) detachably mounted thereto, which are movable along the mold axis for combining both the mold halves (27, 28) at parting faces (29) thereof to form a mold defining a mold cavity (30) to be filled with a melt (74); and an injection unit (60) for injecting the melt into the mold cavity (30).

The apparatus is characterized in that: the mold forms a mold gate (31), at the parting faces (29), extending perpendicularly to the mold axis, through which gate the melt (74) is filled in the cavity (30); the mold clamping unit (20) is swingably mounted on the machine base (100) for rotation about a rotation axis provided at the stationary platen (21) to extend perpendicularly to the mold axis on a horizontal plane, from a horizontal axis position (H) at which the mold axis extends horizontally and the mold clamping unit (20) lies on the machine base (100) at both the stationary and movable platens (21, 22) to receive an upward injection of the melt into the cavity (30) through the mold gate (31) to a vertical axis position (H) where the mold axis extends vertically and the mold clamping unit (20) stands on the machine base (100) at the stationary platen (21); a means (48, 49, 101, 108) connected rotatably to both the machine base (100) and stationary platen (21) is provided for driving the mold clamping unit (20) for rotation about the rotation axis; the injection unit has a casting sleeve (73) through which the melt (74) is injected and is swingably mounted on the machine base (100); and a tilting means (63) connected rotatably to both the injection unit (60) and machine base (100) is provided for tilting the injection unit (60) from a vertical position where the melt (74) is to be injected upwardly to a tilted position where a fresh melt is to be supplied to the casting sleeve (73).

In the apparatus, a stopper means (109, 110, 112) is provided at the movable platen (22) for holding the mold clamping unit (20) at the horizontal axis position (H), so that the tilting injection unit when standing vertically on the machine base (100) is located between the stopper means and the rotation axis.

A piston-cylinder unit (101) rotatably mounted on the machine base (100) is provided as the drive means for actuating a piston rotatably connected to the stationary platen (21).

A means is provided for positioning at least one mold core (10) relative to the mold when the mold is provided with the core (10) therein at the vertical axis position (V). The core positioning means comprises a product separating means (40) mounted to the stationary platen (21) or the stationary mold half (27) for driving axial pins (36) through pin holes formed in the stationary mold half (27), for pushing out a cast product after the movable mold half (28) is separated from the stationary mold half (27), and a means for actuating the product separating means (40) so that axial projections of the push pins (36) from the stationary mold (27) are provided to support the core (10) from below when inserted in the mold, at the vertical axis position.

Further, a mold core unit (42) is provided outside of the mold and on the opposite side to the mold gate (31) for providing a second mold core (41) in the mold, which second core is movable into the mold along a line perpendicular to the mold axis through a hole formed by the parting faces (29); the stationary mold (27) has a recess (27*a*) formed as a shoulder in the inner surface at the mold gate side, for receiving one end of the first mold core (10) temporarily supported by the push pins (36); and the second core (41) has a groove (44) formed therein and facing the parting face (29) of the movable mold (28), for receiving the opposite end of the first core (10) supported by the push pins (36) in corporation with the recess when the second core (41) is moved from an outer position to an inner position. The first core (10) is clamped at the opposite end to complete the insertion of the first core (10) in the mold, after the projected pins (36) are withdrawn from an inner position to an outer one, by both the second core (41) and movable mold half (28) therebetween when the mold halves (27, 28) are joined, at the vertical position (V).

The first core may be disintegratable and made of sand with a resin cover.

The tilting injection unit (60) may comprise: a first piston-cylinder unit (61) for injecting the melt; a plunger rod (66) connected to the piston (64); a sleeve frame (70) connected to the casting sleeve (73); and a second piston-cylinder (68, 69–70), where the sleeve frame (70) forms a movable cylinder and the cylinder of the first piston-cylinder unit (61) forms a stationary piston (68), for activating the sleeve frame (70) with the casting sleeve (73) to move upward relative to the first piston-cylinder unit (61) at the horizontal axis position (H) so that the casting sleeve (73) communicates with the mold gate (31) for the upward injection.

According to the present invention, there is provided a vertically die casting method using the above apparatus comprising, at every casting shot, the steps of: swinging the mold clamping unit (20) about the rotation axis from the horizontal axis position (H) to the vertical axis position (V); providing the mold with at least one mold core therein at the vertical axis position (V); returning the mold clamping unit (20) to the horizontal axis position (H); and injecting the melt upwardly by the injection unit (60) into the mold cavity (30) through the mold gate (31) from below at the horizontal axis position (H).

The method further comprises a step of activating the product separating means at the vertical axis position (V) so that axial projections of the push pins (36) from the stationary mold (27) are provided for the subsequent step of providing the mold with the core (10) therein, whereby the core (10) is supported from below by the projected push pins (36) for positioning the core (10) relative to the mold.

Since the casting device or apparatus of the present invention is the vertical type, gas does not intrude when the melt rises within the casting sleeve (73). Furthermore, when the melt (74) is cast in the cavity (30), the melt is filled in the cavity (30) while rising from the lower portion of the cavity, thus expelling any gas. The air vent formed on the parting faces of the mold halves (27, 28) is not clogged before completion of the filling, and accordingly, the gas is effectively discharged to the outside of the mold throughout the filling operation. If the casting operation is carried out by using the disintegratable core (10) in the above-mentioned manner, a good cast product in which a formation of blow holes or ingot pipings is substantially eliminated can be obtained without breaking the disintegratable core (10).

DESCRIPTION OF THE PREFERRED EMBODIMENTS

Figure 1:
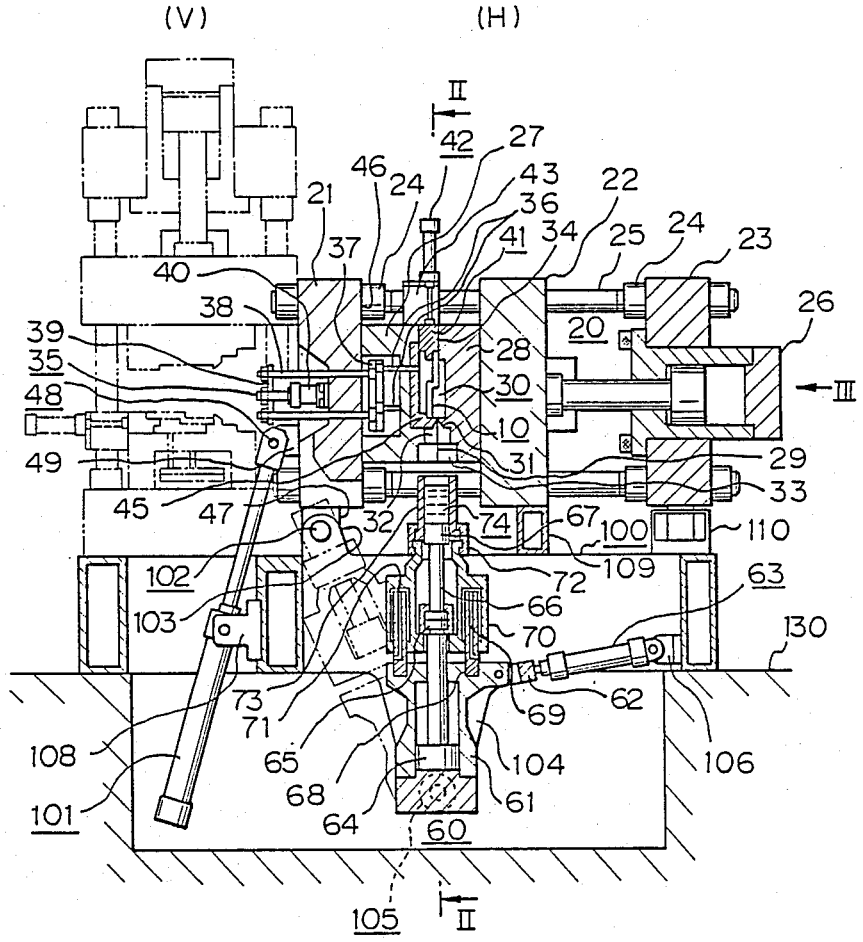
FIG. 1 shows two partially sectional longitudinal views of a vertically die casting apparatus according to the present invention, at a horizontal axis position (H) illustrated by solid lines and at a vertical axis position (V) illustrated by dotted lines, respectively.
Figure 2:
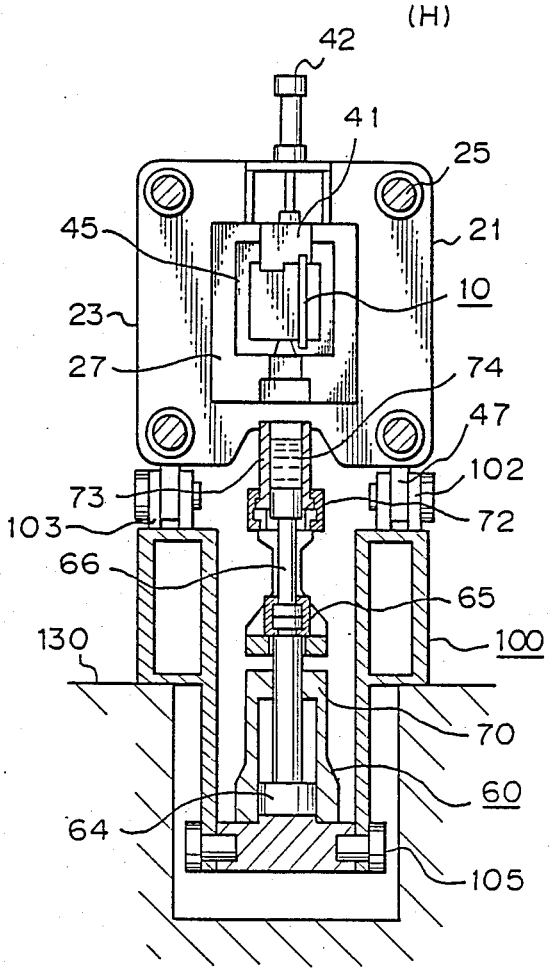
FIG. 2 is a cross sectional view of the apparatus at the horizontal axis position (H), taken along the line II—II of FIG. 1.
Figure 3:
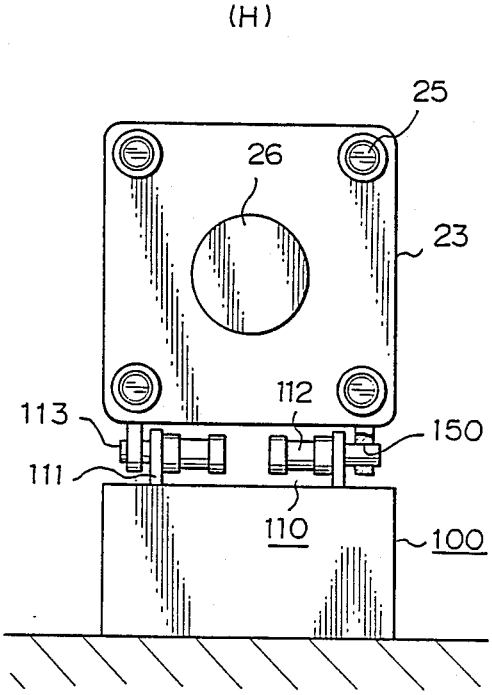
FIG. 3 is a side view showing the apparatus at the horizontal axis position (H), viewed in a direction of the arrow III of FIG. 1.

FIG. 1 shows the longitudinal section of a die casting machine, and illustrates the pressure casting method using a disintegratable core 10 according to the present invention. The structure of the die casting machine is first described with reference to FIG. 1, FIG. 2, FIG. 3, and FIG. 4. The die casting machine comprises a mold clamping device 20, an injection device or unit 60, and a machine base 100 on which the respective devices are arranged and which is secured to a floor surface 130.

The mold clamping device or unit 20 is provided with a stationary platen 21 on one end and a mold clamping cylinder platen 23 on the other end. The four corners of each of the stationary platen 21 and mold clamping cylinder platen 23 are clamped by nuts 24 to form a column 25. A movable platen 22 is supported on the column 25 in such a manner that the movable platen 22 can be advanced and retracted relative to the stationary platen 21 by a mold clamping cylinder 26 attached to the mold clamping cylinder platen 23. A stationary mold half 27 and a movable mold half 28 are attached to the stationary platen 21 and the movable platen 22, respectively, so that the molds are openably and closably combined, with split parting faces 29 as the boundary thereof. Both mold halves 27 and 28 define a cavity 30 having the same shape as that of a cast product, a constricted portion or mold gate 31 subsequent to the cavity 30, a large-diameter hole portion-32 opened downward below the constricted portion 31 subsequent thereto, and a casting sleeve-fitting hole 33, which are divided by the parting face 29. An air vent 34, which is a shallow groove for discharging the gas in the cavity 30 to the outside of the mold at the casting operation, is formed on the parting face 29.

The stationary mold half 27 is provided with a push device 35 comprising a push pin 36 for pushing out a product from the mold, a push pin cylinder 40 secured to the stationary platen 21 to actuate the push pin 36, a push connecting rod 38 for connecting the push pin cylinder 40 to the push pin 36, a push connecting plate 37 for connecting the push pin 36 to the push connecting rod 38, and a push plate 39 for connecting the push pin cylinder 40 to the push connecting rod 38. Moreover, the stationary mold half 27 is further provided with a slidable movable core 41 forming a part of the stationary mold half 27 and defining a part of the cavity 30, a core cylinder 42 in which the movable core 41 is allowed to slide, and a core cylinder attachment bracket 43 for attaching the core cylinder 42 integrally to the stationary mold half 27. A stationary core 45 having a supporting groove 44 defining the cavity 30 and supporting the disintegratable core 10 is built in the stationary mold half 27 on the side of the face of the cavity 30. The supporting groove 44 is also formed on the movable core 41, and thus a disintegratable core 10 can be supported in the space of the cavity 30 by the supporting grooves 44 of the movable core 41 and the stationary core 45 forming a part of the stationary mold half.

On the side opposite to the stationary mold-attaching face 46 of the stationary platen 21 are disposed a pair of rotation cylinders 101 for rotating and driving the entire mold clamping device 20 around a rotation shaft pin 102, and a pair of bearing portions 49 attached rotatably through a pin 48, integral with the stationary platen 21. A bearing portion 103 projected integrally from the machine base 100 for rotating the entire clamping device 20 by the operation of the rotation cylinders 101 and a pair of projected bearing portions 47 integrally forming the center of rotation through the pin 102, are arranged in the lower portion of the stationary platen 21.

The structure of the injection device or unit 60 will now be described. The injection device 60 is connected through a rotation shaft 105 to a pair of injection device-supporting plates 104 arranged below the machine base 100 and integral therewith. The injection device 60 can swing in the longitudinal direction of the mold clamping device 20 with the rotation shaft 105 as the center. The swinging or tilting movement of the injection device 20 is accomplished by a tilting cylinder 63 having one end connected to a bracket 106 attached integrally to the machine base 100, and the other end connected to an injection cylinder 61 through a clevis 62. A piston 64 is arranged within the injecting cylinder 61, and a plunger rod 66 and a plunger tip 67 are connected to the top end of the piston 64 through a plunger coupling 65. A docking ram 68 having a shape resembling a pair of round rods and having an oil pipe path 69 piercing through the interior thereof is arranged on the injection cylinder 61 in such a manner that one end is secured to the injection cylinder 61 and the other end is fitted to an oil-introducing chamber 71 of a sleeve frame 70. A casting sleeve 73 is fixed to the upper end of the sleeve frame 70 through a sleeve coupling 72. The plunger tip 67 is slidably engaged with the interior of the casting sleeve 73. A melt 74 is poured into the casting sleeve 73 by a melt supply device, not shown in the drawings.

The structure of the machine base 100 will now be described, A stopper 107 for setting the position of the erect posture of the mold clamping device 20, which rotates around the rotation shaft 102 when the disintegratable core 10 is attached to the molds or a product is withdrawn from the molds, is arranged integrally with the machine base 100 in the end portion of the machine base 100 on the side of the stationary platen 21. In the vicinity of the lower part of the stationary platen 21, a cylinder bearing 108 having the above-mentioned rotation cylinders 101 rotatably attached thereto is arranged integrally with the machine base 100. A pair of stoppers 109 for setting the position of the molding clamping device 20 when rotated to a horizontal posture or a horizontal axis position (H) are arranged on the upper face of the machine base 100 integrally therewith in the vicinity of the movable platen 22.

The device 110 for preventing a rising of the mold clamping device 20 during the casting operation will now be described. A pair of setting plates 111 projected from the machine base 100 and integral therewith are arranged on the upper surface of the machine base 100 in the vicinity of the mold clamping cylinder plate 23, a cylinder 112 for preventing a rising of the mold clamping device 20 is arranged on each of the setting plates 111, and a rising-preventing pin 113 is attached to the top end of the rod of the rising-preventing cylinder 112. This pin 113 is engaged with a hole 150 projected below the mold clamping plate 23 and integral therewith at the time of injection, to prevent a rising of the mold clamping device 20.

The disintegratable core 10 defining an undercut portion or cavity portion of a cast product will now be described. A sand core is molded from a sand for a shell mold, which comprises 100 parts of siliceous sand JIS No. 7 as the aggregate, 2.0 parts of a thermosetting phenolic resin as the organic binder, and 0.1 part of calcium stearate as the lubricant. The molding conditions are; a mole temperature of 270° and a calcination time of 20 seconds. Then, 1 l of water is thoroughly mixed and stirred with 300 cc of colloidal silica ($SiO_2$=30%) as the binder, 10 g of sodium dodecylbenzene-sulfonate as the lubricant, and 1 g of octyl alcohol as the defoaming agent, 300 g of zircon flower pulverized to a size smaller than 300 mesh is added to the solution, and the mixture is thoroughly stirred to form a slurry solution. The above-mentioned shell core is immersed in the slurry solution for 1 minute to fill surface voids of the sand core and, immediately, the sand core is dried for 30 minutes by a hot air drier at 120° C. to harden the surface of the core.

A slurry solution formed by thoroughly mixing and stirring 1 l of a 3% aqueous solution of a water-soluble phenolic resin with 500 g of mica pulverized to a size smaller than 300 mesh, 10 g of sodium dodecylbenzenesulfonate as the lubricant, and 1 g of octyl alcohol as the defoaming agent is brush-coated on the surface of the sand core and the sand core is dried for 1 hour by a drier at 120° C.

The operation of the die casting apparatus having the above-mentioned structure will now be described, with reference to FIG. 1 and FIGS. 5A to 5F.

Figure 4:
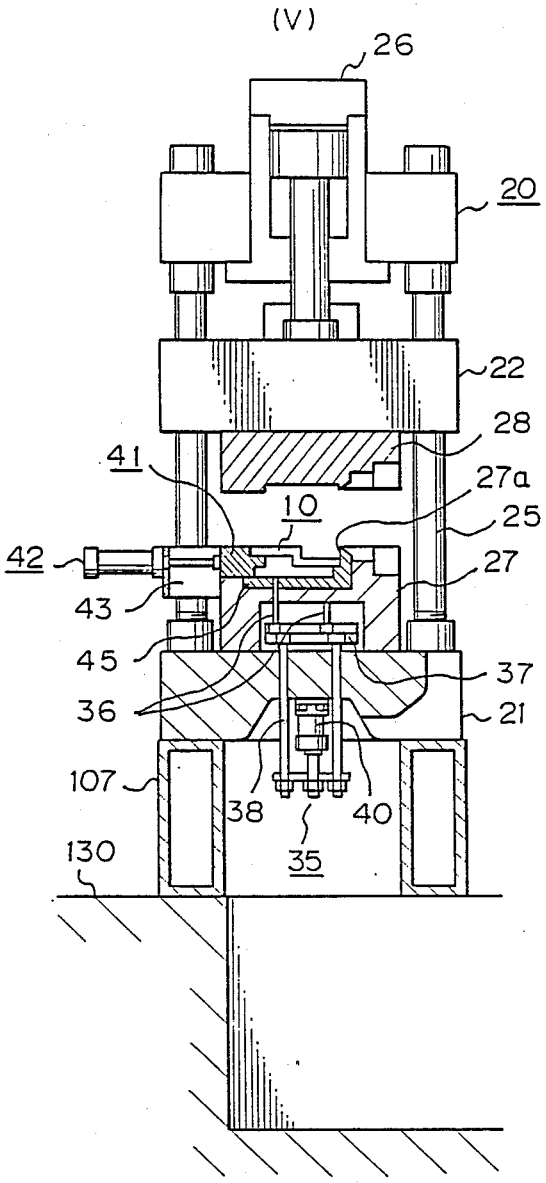
FIG. 4 is a partially sectional view of the apparatus at the vertical axis position (V), illustrated by solid lines.
Figure 5A:
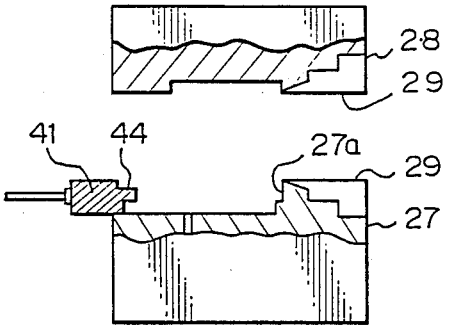
FIGS. 5A, 5B, 5C, 5D, 5E and 5F are sectional view diagrams showing, in this order, steps for forming a process of providing a mold comprises of stationary and movable mold halves with a disintegratable core incorporated with a movable core at the vertical axis position (V) of the casting apparatus according to the present invention.
Figure 5B:
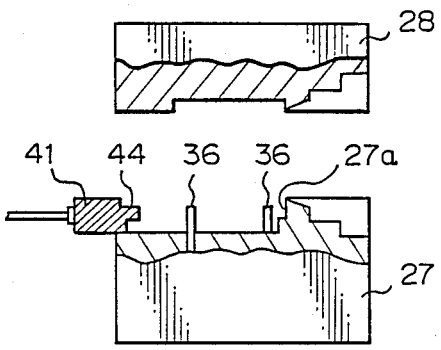
Figure 5C:
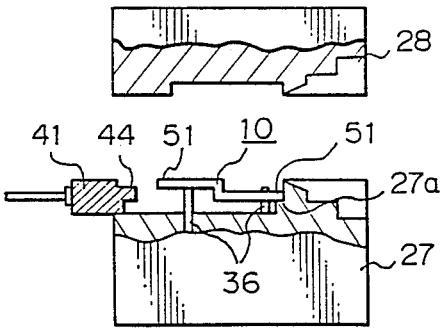
Figure 5D:
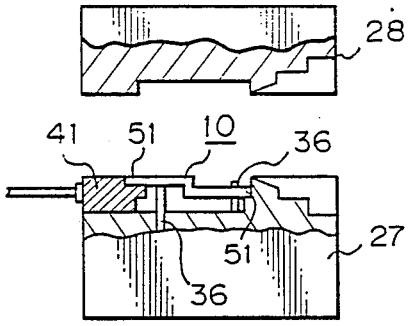
Figure 5E:
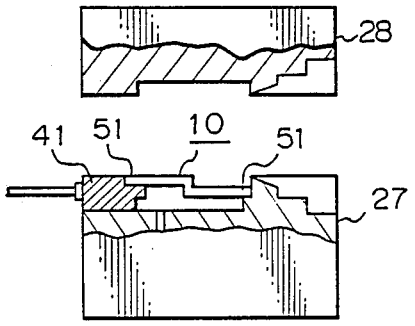
Figure 5F:
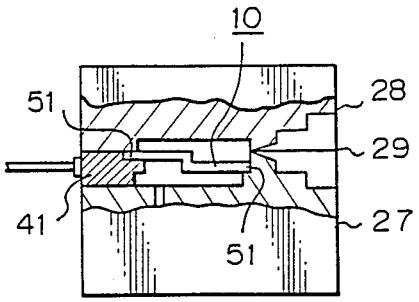

When the disintegratable core 10 is attached to the mold, in the state wherein the rotation cylinder 101 is withdrawn, the entire mold clamping device 20 takes an erect posture, i.e., the vertical axis position (V), in which the parting face 29 lies is in the horizontal direction, as indicated by two-dot chain lines in FIG. 1 and by solid lines in FIG. 4. The movable mold half 28 defining the cavity 30 is opened by retraction of the mold clamping cylinder 26 (FIG. 5A), and the movable core 41 is opened by retraction of the core cylinder 42 (FIG. 5A). In this state, oil is fed to the rod end side of the push pin cylinder 40 and the push pin 36 is projected into the cavity 30 to form a temporary supporting stand for holding the disintegratable core 10 in the cavity 30 (FIG. 5B) at a recess (27*a*) of the stationary mold half (27). By a device for automatically setting the disintegratable core (not shown), the disintegratable core 10 is delivered to the upper portion of the stationary mold half 27 and is arranged on the push pin 36 in a state wherein one skirt portion 51 is engaged with the supporting groove 44 of the movable core 41 (FIG. 5C). Then, the oil is guided to the head end side of the core cylinder 42 and the movable core 41 is advanced, and thus the supporting groove 44 of the movable core 41 is engaged with the skirt portion 51 on one end of the disintegratable core 10 (FIG. 5D). The push pin 36 is then retracted and the attachment of the disintegratable core 10 to the cavity 30 is completed (FIG. 5E). Oil is then fed to the head end side of the mold clamping cylinder 26 to advance the mold clamping cylinder 26, and the clamping of the molds is completed (FIG. 5F). When the molds are clamped, the oil is fed to the head end side of the rotation cylinder 101 to rotate the entire mold clamping device 20 around the rotation shaft 102, and the mold clamping device 20 takes the horizontal posture or the horizontal axis position (H) and stops when the movable platen 22 impinges against the stopper 109. When the rotation is completely stopped, the oil is fed to the head end side of the rising-preventing cylinder 112 arranged on the machine base 100 to insert the rising-preventing pin 113 into the hole 150 of the mold clamping cylinder plate 23. In connection with the operation of the injection device 60, when the tilting device 63 pushes, i.e., when the injection cylinder 61 is tilted, the melt 74 is poured into the casting sleeve 73 by an automatic melt supply device, not shown in the drawings. On completion of the pouring of the melt 74, the oil is fed to the rod end side of the tilting cylinder 63 and the injection device 60 is rotated to an erect posture or a vertical axis position. On completion of the rotation, the oil is fed into the oil introduction chamber 71 of the sleeve frame 70 through the oil pipe path 69 of the docking ram 68, and the melt 74 in the casting sleeve 73, the casting sleeve 73, the sleeve frame 70, the plunger tip 67, the plunger rod 66, and the piston of the injection cylinder 61 are integrally elevated, and the upper face of the casting sleeve 73 is impinged against the upper face of the casting sleeve-fitting hole 32 formed by the stationary mold half 27 and movable mold half 28 and stopper. On completion of the elevation of the casting sleeve 73, the oil is fed to the head end side of the injection cylinder 61 to elevate the piston 64, and thus the melt 74 is made to rise in the casting sleeve 73 without an intrusion of gas. The piston 64 is further elevated and the melt 74 is cast in the cavity 30 vertically, but since the melt 74 is filled in the cavity in the rising state, gas does not intrude into the cavity 30. The gas in the cavity 30 is expelled by the melt 74 and is discharged to the outside of the mold through the gas-discharge vent 34 formed on the parting faces 29. When the cavity is completely filled with the melt 74, the force at the injection cylinder 61 trys to raise the entire mold clamping device 20, but any rising or rotation of the mold clamping device 20 is prevented by the rising-preventing pin 113.

When solidification and cooling of the melt are completed after a predetermined time, the oil is fed to the rod end side of the injection cylinder 61 and the piston 64 is withdrawn. Midway in this withdrawal movement, the plunger coupling 65 impinges against the sleeve frame 70. At this point, the pressure in the oil introduction chamber 71 of the sleeve frame 70 of the docking ram 68 is released, and the casting sleeve 73 and sleeve frame 70 are pressed down and are withdrawn simultaneously with the withdrawal of the piston 64. On completion of this withdrawal movement, the oil is fed to the head end side of the tilting cylinder 63 to tilt the injection device 60, and the injection device 60 is returned to the vertical axis position (V) indicated by the two-dot chain lines in FIG. 1 and solid lines in FIG. 4. The oil is then fed to the rod end side of the rotation cylinder 101 to rotate the mold clamping device 20, and the mold clamping device 20 impinges against the stopper 107 of the machine base 100 and stops in the erect state indicated by the two-dot chain lines in FIG. 1. On completion of the rotation, the oil is fed to the rod end side of the mold clamping cylinder 26 to open the mold. Furthermore, the oil is fed to the rod end side of the core cylinder 42 to retract the movable core 41, and then the oil is fed to the rod end side of the push pin cylinder 40 to push out a product left in the mold halves to outside of the mold. On completion of this push, the oil is fed to the head end side of the push pin cylinder 40 to return the push pins 36. Thus, one cycle of the casting operation is completed.

As an experiment, an aluminum alloy ADC12 was cast under conditions of a melt temperature of 680° C., a metal pressure of 400 kg/cm$^2$, and a plunger speed of 50 mm/sec.

The sand was removed from the cast product discharged from the mold, and it was found that no intrusion of the sand into the surface of the disintegratable sand core 10 had occurred and a high-quality cast product free of blow holes and cavities, such as ingot pipings in the interior, was obtained.

As apparent from the foregoing description, if the disintegratable core is disposed in the mold halves in the state wherein the mold clamping device takes an erect posture or the vertical axis position (V) and the parting faces of the mold lie in the horizontal direction, the position of the disintegratable core in the mold cavity is precisely set, and breaking of the disintegratable core by contact with the movable core or movable mold half at the time of closing of the mold halves, or degradation of the quality of the cast product due to eroded sand, does not occur. Moreover, if the casting operation is carried out by the vertical casting apparatus at the horizontal axis position (H) with the injection device kept vertical, gas does not intrude into the melt and a cast product having a high quality can be obtained.

We claim:

1. A vertical die casting method using an apparatus composed of: a machine base; a mold clamping unit having a mold axis, incorporated with a mold half movable along the mold axis and another mold half stationary relative to the mold axis so that both mold halves are joined at parting faces thereof to form a mold defining a mold cavity to be filled with a melt through a mold gate formed at the parting faces to extend perpendicular to the mold axis, and mounted swingably on the machine base at a side of the stationary mold half for rotation about a rotation axis perpendicular to the mold axis on a horizontal plane; and a tilting or laterally movable injection unit for injecting the melt upwardly into the mold cavity through the mold gate at a lateral or horizontal axis position where the mold extends horizontally, comprising, at every casting shot, the steps of: swinging the mold clamping unit about the rotation axis from said horizontal axis position to a vertical axis position where the mold axis extends vertically; providing the mold with at least one mold core therein at said vertical axis position; returning the mold clamping unit to said horizontal position; and injecting the melt upwardly by said injection unit into the mold cavity through the mold gate from below at said horizontal axis position.

2. A die casting method according to claim 1, wherein the mold clamping unit is provided with a product separating means for driving axial push pins through pin holes formed in the stationary mold half for pushing out a cast product after the movable mold half is separated from the stationary mold half, further comprising a step of activating the product separating means at said vertical axis position so that axial projections of the push pins from the stationary mold half are maintained for the subsequent step of providing the mold with the core therein whereby the core is supported from below by the projected push pins for positioning the core relative to the mold.

3. A vertical die casting method according to any one of claim 1 and 2, wherein said core is disintegratable and made of sand with a resin binder.

4. A die casting machine comprising: a machine base; a mold clamping unit having a mold axis, incorporated with a platen and mold half detachably mounted thereto and stationary relative to said mold axis, and a counterpart platen and mold half detachably mounted thereto and movable along the mold axis for combining both said mold halves at parting faces thereof to form a mold defining a mold cavity to be filled with a melt; and an injection unit for injecting the melt into said mold cavity, characterized in that: said mold forms a mold gate, at the parting faces, extending perpendicularly to said mold axis, through which gate the melt is supplied to said cavity; said mold clamping unit is swingably mounted on said machine base for rotation about a rotation axis provided at said stationary platen to extending perpendicularly to said mold axis on a horizontal plane, from a horizontal axis position where said mold axis extends horizontally and said mold clamping unit lies on said machine base at both said stationary and movable platens to receive an upward injection of the melt into said cavity through said mold gate to a vertical axis position where said mold axis extends vertically and said mold clamping unit stands on said machine base at said stationary platen; a means connected rotatably to both said machine base and said stationary platen for driving said mold clamping unit for rotation about said rotation axis; said injection unit having a casting sleeve through which the melt is injected and is swingably mounted on said machine base; and a tilting means connected rotatably to both said injection unit and machine base for tilting said injection unit from a vertical position where the melt is to be injected upwardly to a tilted position where a fresh melt is supplied to said casting sleeve.

5. A die casting machine according to claim 4, wherein a stopper means is provided at said movable platen for holding said mold clamping unit at said horizontal axis position, so that said injection unit when standing vertically on said machine base is located between said stopper means and said rotation axis.

6. A die casting machine according to claim 5, wherein said driving means is a piston-cylinder unit rotatably mounted on said machine base for actuating a piston rotatably connected to said stationary platen.

7. A die casting machine according to claim 6, wherein a means is provided for positioning at least one mold core relative to said mold when said mold is provided with said core therein at said vertical axis position.

8. A die casting machine according to claim 7, wherein said core positioning means comprises a product separating means mounted to said stationary platen or said stationary mold half for driving axial push pins through pin holes formed in said stationary mold half for pushing a cast product after said movable mold half is separated from said stationary mold half and a means for actuating said product separating means so that axial projections of said push pins from said stationary mold half are maintained to thereby support said core from below when provided in said mold, at said vertical axis position.

9. A die casting machine according to claim 8, wherein: provided is a mold core unit outside of said mold opposite to the side of said mold gate for providing a second mold core in said mold, which second core is movable into said mold along a line perpendicular to said mold axis through a hole formed by the parting faces; said stationary mold half having a recess formed in the inner surface at the mold gater side, for receiving one end of said first mentioned core while temporarily supported by said push pins; and said second core has a groove formed to face the parting face of said movable mold half, for receiving the opposite end of said first core supported by said push pins in corporation with said recess when said second core is moved from an outer position to an inner one, said first core being clamped at said opposite end for completion of the provision of said first core in said mold, after said projected push pins are withdrawn from an inner position to an outer one, by both said second core and movable mold half therebetween when said mold halves are joined, at said vertical axis position.

10. A die casting machine according to claim 9, wherein said first core is disintegratable and made of sand with a resin binder.

11. A die casting machine according to any one of claims 4 to 10, wherein said injection unit comprises: a first piston-cylinder unit for injecting the melt; a plunger rod connected to said piston; a sleeve frame connected to said casting sleeve; and a second piston-cylinder unit, where said sleeve frame forms a movable cylinder and said cylinder of said first piston-cylinder unit forms a stationary piston, for activating said sleeve frame with said casting sleeve to move upward relative to said first piston-cylinder unit at said horizontal axis position so that said casting sleeve communicates with said mold gate for the upward injection.

* * * * *

UNITED STATES PATENT AND TRADEMARK OFFICE

CERTIFICATE OF CORRECTION

PATENT NO. : 4,836,267

DATED : June 6, 1989

INVENTOR(S) : Ueno et al.

It is certified that error appears in the above-identified patent and that said Letters Patent is hereby corrected as shown below:

Claim 4, column 9, line 64, change "extending" to --extend--; and

Claim 9, column 10, line 50, change "gater" to --gate--.

Signed and Sealed this

Twenty-third Day of April, 1991

*Attest:*

HARRY F. MANBECK, JR.

*Attesting Officer*

*Commissioner of Patents and Trademarks*